US012144451B1

(12) United States Patent
Chen

(10) Patent No.: US 12,144,451 B1
(45) Date of Patent: Nov. 19, 2024

(54) PILLOWCASE

(71) Applicant: JingWeiLianHe (Hong Kong) Technology Co., Limited, Hong Kong (HK)

(72) Inventor: Xin Chen, Hong Kong (HK)

( * ) Notice: Subject to any disclaimer, the term of this patent is extended or adjusted under 35 U.S.C. 154(b) by 0 days.

(21) Appl. No.: 18/431,710

(22) Filed: Feb. 2, 2024

(30) Foreign Application Priority Data

Jan. 25, 2024 (CN) ..... 202420194051.1

(51) Int. Cl.

| | |
|---|---|
| ***A47G 9/02*** | (2006.01) |
| ***A47C 7/38*** | (2006.01) |
| ***A47G 9/10*** | (2006.01) |
| ***D06M 15/59*** | (2006.01) |

(52) U.S. Cl.
CPC ..... *A47G 9/0253* (2013.01); *A47C 7/383* (2013.01); *A47G 9/10* (2013.01); *D06M 15/59* (2013.01)

(58) Field of Classification Search
CPC ..... A47G 9/0253; A47G 9/10; A47C 7/38; A47C 7/383; A47C 20/00; A47C 20/02; D06M 15/59
USPC ..... 5/645, 641, 638, 636, 490
See application file for complete search history.

(56) References Cited

U.S. PATENT DOCUMENTS 2,085,296 A * 6/1937 Carey ..... A61G 7/05723 128/889
2010/0166832 A1* 7/2010 Ingle ..... D06M 23/16 2/400

FOREIGN PATENT DOCUMENTS

CN 108938436 A * 12/2018 ..... A41D 13/11
EP 3760238 A1 * 1/2021 ..... A41B 17/00

* cited by examiner

*Primary Examiner* — Robert G Santos

(57) ABSTRACT

A pillowcase includes a pillowcase main body. The pillowcase main body is made of a fabric. The pillowcase main body includes an upper covering surface and a lower covering surface. The upper covering surface is connected to the lower covering surface to form a first accommodating space around the upper covering surface and the lower covering surface. The first accommodating space is configured to accommodate a pillow interior. The fabric includes a carrier and a care agent. The care agent is mixed with the carrier. A material of the carrier includes spandex and a polyamide fiber. The carrier of the fabric is composed of the polyamide fiber and the spandex. This combination can provide good wear resistance, elasticity, and comfort, so that the pillowcase is more durable and suitable for long-term use. Meanwhile, due to the addition of the care agent, this pillowcase can have a skincare effect.

8 Claims, 5 Drawing Sheets

PILLOWCASE

CROSS-REFERENCE TO RELATED APPLICATIONS

The application claims priority of Chinese patent application CN2024201940511, filed on Jan. 25, 2024, which is incorporated herein by reference in its entireties.

TECHNICAL FIELD

The present disclosure relates to the field of pillowcases, and in particular, to a pillowcase.

BACKGROUND

It is usually very busy in modern life, and many people may not have enough time in the day to do tedious skincare. However, even in such a busy situation, people have fixed sleep time every night. Meanwhile, in a deep sleep stage, cells in the human body will be repaired and regenerated fastest. When skincare is combined with sleep, it is possible to better use this period of time for skin repair, thereby making the skincare effect more significant. Therefore, there is an urgent need on the market to provide a pillow or pillowcase that combines skincare with sleep.

SUMMARY

In order to overcome the shortcomings of the prior art, the present disclosure provides a pillowcase, including:

a pillowcase main body, wherein the pillowcase main body is made of a fabric; the pillowcase main body includes an upper covering surface and a lower covering surface; the upper covering surface is connected to the lower covering surface to form a first accommodating space around the upper covering surface and the lower covering surface; the first accommodating space is configured to accommodate a pillow interior; the fabric includes a carrier and a care agent; the care agent is mixed with the carrier; and a material of the carrier includes spandex and a polyamide fiber.

As the improvement of the present disclosure, the carrier is formed by interweaving the polyamide fiber with the spandex, so that the fabric has good elasticity, breathability, wear resistance, and creasing resistance.

As the improvement of the present disclosure, the polyamide fiber in the carrier accounts for 60% to 95%, and the spandex accounts for 40% to 5%.

As the improvement of the present disclosure, the care agent is mixed with the carrier through an immersion method; a liquid pick-up rate is controlled between 60% and 80%; and shaping and drying are carried out to mix the care agent with the carrier.

As the improvement of the present disclosure, the care agent is added to the carrier according to a ratio of 20 g/L to 50 g/L.

As the improvement of the present disclosure, the pillowcase main body includes a front side, a rear side, a left side, a right side, an upper side, and a lower side; a distance from the left side to the right side is a first distance, and the first distance is 30 cm to 145 cm; a distance from the front side to the back side is a second distance, and the second distance is 15 cm to 60 cm; a distance from the upper side to the lower side is a third distance; and the third distance is 0 to 16 cm.

As the improvement of the present disclosure, the pillowcase main body at least includes one accommodating opening; and the pillow interior is placed in the first accommodating space through the accommodating opening.

As the improvement of the present disclosure, the care agent at least includes sodium hyaluronate.

As the improvement of the present disclosure, the care agent further includes at least one of a moisturizer, an antioxidant, and a spice.

The present disclosure also provides a pillow, including:

a pillow interior; and a pillowcase main body, wherein the pillowcase main body is made of a fabric; the pillowcase main body includes an upper covering surface and a lower covering surface; the upper covering surface is connected to the lower covering surface to form a first accommodating space around the upper covering surface and the lower covering surface; the first accommodating space is configured to accommodate the pillow interior; the fabric includes a carrier and a care agent; the care agent is mixed with the carrier; and a material of the carrier includes spandex and a polyamide fiber.

As the improvement of the present disclosure, the carrier is formed by interweaving the polyamide fiber with the spandex, so that the fabric has good elasticity, breathability, wear resistance, and creasing resistance.

As the improvement of the present disclosure, the polyamide fiber in the carrier accounts for 60% to 95%, and the spandex accounts for 40% to 5%.

As the improvement of the present disclosure, the care agent is mixed with the carrier through an immersion method; a liquid pick-up rate is controlled between 60% and 80%; and shaping and drying are carried out to mix the care agent with the carrier.

As the improvement of the present disclosure, the care agent is added to the carrier according to a ratio of 20 g/L to 50 g/L.

As the improvement of the present disclosure, the pillowcase main body includes a front side, a rear side, a left side, a right side, an upper side, and a lower side; a distance from the left side to the right side is a first distance, and the first distance is 30 cm to 145 cm; a distance from the front side to the back side is a second distance, and the second distance is 15 cm to 60 cm; a distance from the upper side to the lower side is a third distance; and the third distance is 0 to 16 cm.

As the improvement of the present disclosure, the pillowcase main body at least includes one accommodating opening; and the pillow interior is placed in the first accommodating space through the accommodating opening.

As the improvement of the present disclosure, the care agent at least includes sodium hyaluronate.

As the improvement of the present disclosure, the care agent further includes at least one of a moisturizer, an antioxidant, and a spice.

As the improvement of the present disclosure, a material of the pillow interior includes at least one of down feather, memory foam, latex, and fibers.

As the improvement of the present disclosure, the pillow interior has a first through channel; the first through channel penetrates from an upper side to a lower side of the pillow interior; the upper covering surface of the pillowcase main body includes a first connecting part; the lower covering surface of the pillowcase main body includes a second connecting part; and the first connecting part and the second connecting part are detachably connected into the first through channel.

As the improvement of the present disclosure, the upper covering surface and the lower covering surface are detachably connected.

The present disclosure has the following beneficial effects. The present disclosure provides a pillowcase. The pillowcase includes a pillowcase main body, wherein the pillowcase main body is made of a fabric; the pillowcase main body includes an upper covering surface and a lower covering surface; the upper covering surface is connected to the lower covering surface to form a first accommodating space around the upper covering surface and the lower covering surface; the first accommodating space is configured to accommodate a pillow interior; the fabric includes a carrier and a care agent; the care agent is mixed with the carrier; and a material of the carrier includes spandex and a polyamide fiber. The carrier of the fabric is composed of the polyamide fiber and the spandex. This combination can provide good wear resistance, elasticity, and comfort, so that the pillowcase is more durable and suitable for long-term use. Meanwhile, due to the addition of the care agent, this pillowcase can have a skincare effect.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
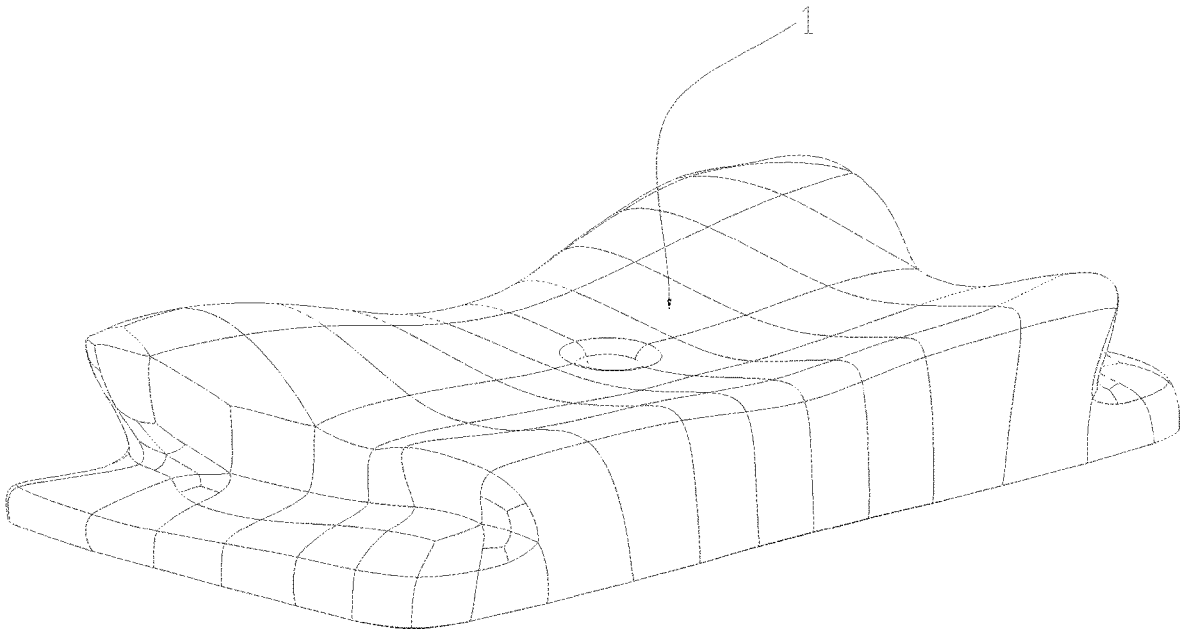
FIG. 1 is a schematic diagram of an entire structure of a pillowcase according to the present disclosure.
Figure 2:
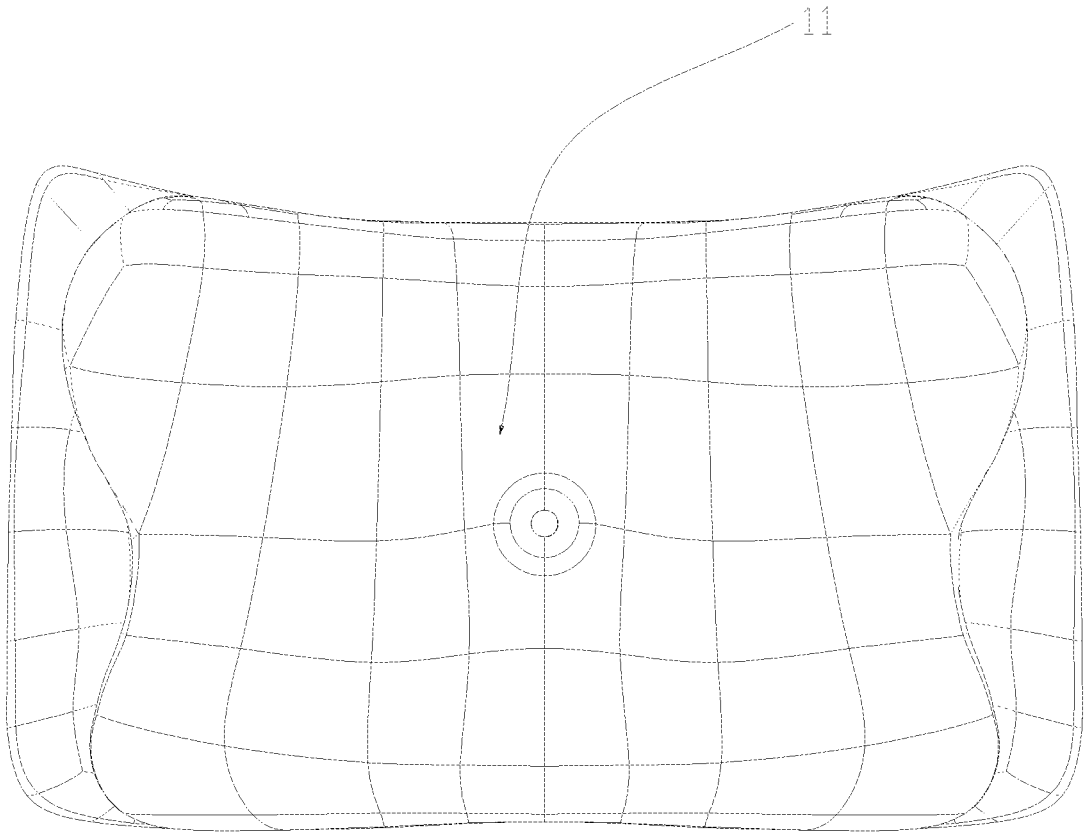
FIG. 2 is a top view of a pillowcase according to the present disclosure.
Figure 3:
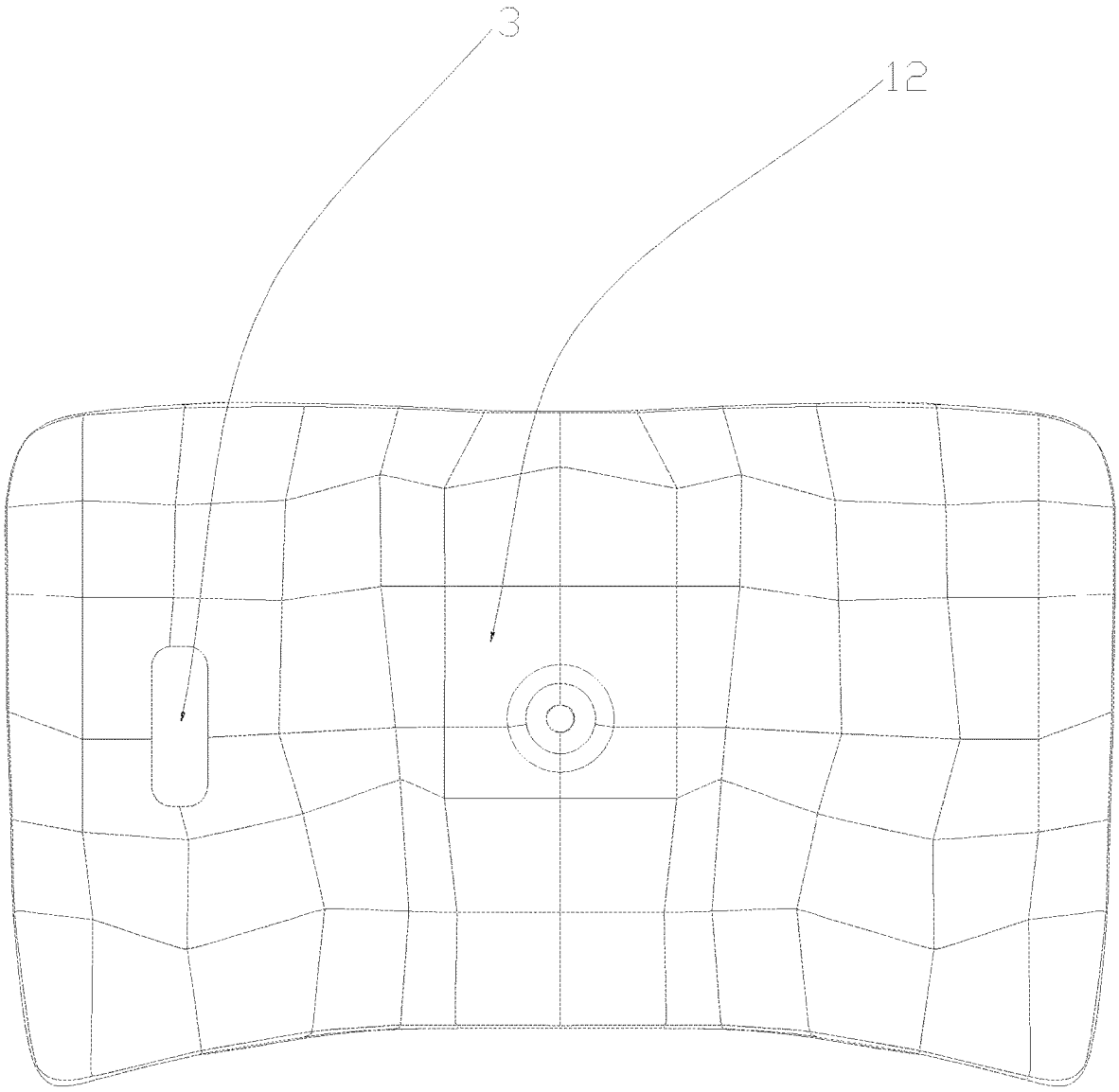
FIG. 3 is a bottom view of a pillowcase according to the present disclosure.
Figure 4:
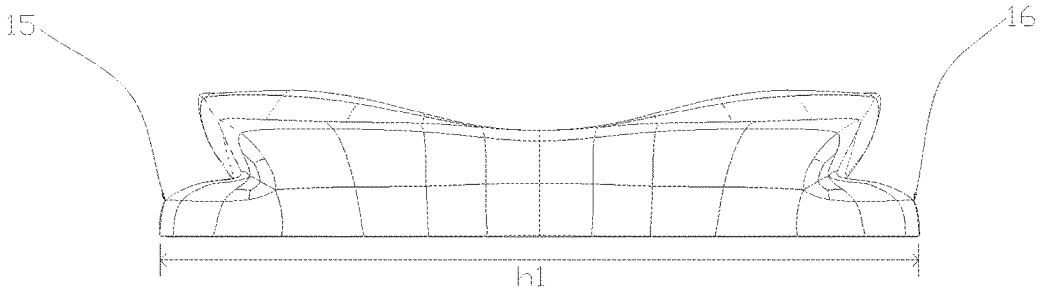
FIG. 4 is a front view of a pillowcase according to the present disclosure.

Referring to FIG. 1 to FIG. 6, a pillowcase includes:

a pillowcase main body 1, wherein the pillowcase main body 1 is made of a fabric: the pillowcase main body 1 includes an upper covering surface 11 and a lower covering surface 12: the upper covering surface 11 is connected to the lower covering surface 12 to form a first accommodating space 2 around the upper covering surface 11 and the lower covering surface 12: the first accommodating space 2 is configured to accommodate a pillow interior: the fabric includes a carrier and a care agent: the care agent is mixed with the carrier; and the carrier is composed of spandex and a polyamide fiber. The carrier of the fabric is composed of the polyamide fiber and the spandex. This combination can provide good wear resistance, elasticity, and comfort, so that the pillowcase is more durable and suitable for long-term use. Meanwhile, due to the addition of the care agent, this pillowcase can have a skincare effect.

In this embodiment, the carrier is formed by interweaving the polyamide fiber with the spandex, so that the fabric has good elasticity, breathability, wear resistance, and creasing resistance.

In this embodiment, the polyamide fiber in the carrier accounts for 60% to 95%, and the spandex accounts for 40% to 5%. The polyamide fiber is a high-strength synthetic fiber. The polyamide fiber in a high ratio can improve the overall strength and wear resistance of the fabric. The spandex has good elasticity, and an appropriate amount of spandex can make the fabric more elastic and improve the comfort of the pillowcase. A small amount of spandex can improve the moisture absorption of the fabric, which helps to keep a surface of the pillowcase dry and comfortable. The polyamide fiber in the high ratio has good creasing resistance, and the spandex in the low ratio makes the fabric easier to care for. This pillowcase is easier to clean and is dried faster, which reduces the cleaning burden on a user.

In this embodiment, the care agent is mixed with the carrier through an immersion method: a liquid pick-up rate is controlled between 60% and 80%; shaping and drying are carried out to mix the care agent with the carrier; and the care agent is added to the carrier according to a ratio of 20 g/L to 50 g/L. Controlling the pick-up rate between 60% and 80% can help adjust the content of the care agent. This can balance the care effect with the comfort of the fabric, avoiding the sticky feel caused by an excessive amount of the care agent. In addition, the shaping and drying process helps to combine the immersed care agent with the carrier, so as to ensure that the care agent and the carrier are fixed in the fabric. This helps to improve the durability of the care agent, keeping the care agent effective within a long time period.

In this embodiment, the pillowcase main body 1 includes a front side 13, a rear side 14, a left side 15, a right side 16, an upper side 17, and a lower side 18; a distance from the left side 15 to the right side 16 is a first distance h1, and the first distance h1 is 30 cm to 145 cm; a distance from the front side 13 to the back side 14 is a second distance h2, and the second distance h2 is 15 cm to 60 cm; a distance from the upper side 17 to the lower side 18 is a third distance h3; and the third distance h3 is 0 to 16 cm.

In this embodiment, the pillowcase main body 1 at least includes one accommodating opening 3; and the pillow interior is placed in the first accommodating space 2 through the accommodating opening 3. Through the accommodating opening, the user can more easily adjust the position of the pillow interior to meet a personal comfort need for better support and comfort.

In this embodiment, the care agent at least includes sodium hyaluronate. Hyaluronic acid can absorb and retain moisture. Adding the sodium hyaluronate to the pillowcase can provide an additional moisturizing effect and helps to prevent the skin from becoming rough due to friction and dryness during sleep. In addition, the hyaluronic acid helps maintain the skin elasticity, so that the skin appears fuller and more radiant, achieving a skincare effect.

In this embodiment, the care agent further includes at least one of a moisturizer, an antioxidant, and a spice. The moisturizer helps absorb and lock moisture, improve the softness of the pillowcase, and improve the comfort during sleep. Secondly, the antioxidant helps slow down the aging of the surface of the pillowcase, keeps the appearance clean, and improves the durability. In addition, the spice can provide the user with a more pleasant sleep environment, help relax the body and mind, and help improve the sleep quality. In addition, vitamins or amino acids can also be added into the care agent. Adding the amino acids can help reduce dryness, fragility, and branching of the hairs. This improves the softness and glossiness of the hairs. Adding the vitamins can provide additional care for the skin.

A pillow includes:

a pillow interior 4; and a pillowcase main body 1, wherein the pillowcase main body 1 is made of a fabric: the pillowcase main body 1 includes an upper covering surface 11 and a lower covering surface 12: the upper covering surface 11 is connected to the lower covering surface 12 to form a first accommodating space 2 around the upper covering surface 11 and the lower covering surface 12: the first accommodating space 2 is configured to accommodate the pillow interior 4; the fabric includes a carrier and a care agent; the care agent is mixed with the carrier; and the carrier is composed of spandex and a polyamide fiber. The carrier of the fabric is composed of the polyamide fiber and the spandex. This combination can provide good wear resistance, elasticity, and comfort, so that the pillowcase is more durable and suitable for long-term use. Meanwhile, due to the addition of the care agent, this pillowcase can have a skincare effect.

In this embodiment, the carrier is formed by interweaving the polyamide fiber with the spandex, so that the fabric has good elasticity, breathability, wear resistance, and creasing resistance.

In this embodiment, the polyamide fiber in the carrier accounts for 60% to 95%, and the spandex accounts for 40% to 5%. The polyamide fiber is a high-strength synthetic fiber. The polyamide fiber in a high ratio can improve the overall strength and wear resistance of the fabric. The spandex has good elasticity, and an appropriate amount of spandex can make the fabric more elastic and improve the comfort of the pillowcase. A small amount of spandex can improve the moisture absorption of the fabric, which helps to keep a surface of the pillowcase dry and comfortable. The polyamide fiber in the high ratio has good creasing resistance, and the spandex in the low ratio makes the fabric easier to care for. This pillowcase is easier to clean and is dried faster, which reduces the cleaning burden on a user.

In this embodiment, the care agent is mixed with the carrier through an immersion method: a liquid pick-up rate is controlled between 60% and 80%; shaping and drying are carried out to mix the care agent with the carrier; and the care agent is added to the carrier according to a ratio of 20 g/L to 50 g/L. Controlling the pick-up rate between 60% and 80% can help adjust the content of the care agent. This can balance the care effect with the comfort of the fabric, avoiding the sticky feel caused by an excessive amount of the care agent. In addition, the shaping and drying process helps to combine the immersed care agent with the carrier, so as to ensure that the care agent and the carrier are fixed in the fabric. This helps to improve the durability of the care agent, keeping the care agent effective within a long time period.

In this embodiment, the pillowcase main body 1 includes a front side 13, a rear side 14, a left side 15, a right side 16, an upper side 17, and a lower side 18; a distance from the left side 15 to the right side 16 is a first distance h1, and the first distance h1 is 30 cm to 145 cm; a distance from the front side 13 to the back side 14 is a second distance h2, and the second distance h2 is 15 cm to 60 cm; a distance from the upper side 17 to the lower side 18 is a third distance h3; and the third distance h3 is 0 to 16 cm.

In this embodiment, the pillowcase main body 1 at least includes one accommodating opening 3; and the pillow interior 4 is placed in the first accommodating space 2 through the accommodating opening 3. Through the accommodating opening, the user can more easily adjust the position of the pillow interior 4 to meet a personal comfort need for better support and comfort.

In this embodiment, the care agent at least includes sodium hyaluronate. Hyaluronic acid can absorb and retain moisture. Adding the sodium hyaluronate to the pillowcase can provide an additional moisturizing effect and helps to prevent the skin from becoming rough due to friction and dryness during sleep. In addition, the hyaluronic acid helps maintain the skin elasticity, so that the skin appears fuller and more radiant, achieving a skincare effect.

In this embodiment, the care agent further includes at least one of a moisturizer, an antioxidant, and a spice. The moisturizer helps absorb and lock moisture, improve the softness of the pillowcase, and improve the comfort during sleep. Secondly, the antioxidant helps slow down the aging of the surface of the pillowcase, keeps the appearance clean, and improves the durability. In addition, the spice can provide the user with a more pleasant sleep environment, help relax the body and mind, and help improve the sleep quality. In addition, vitamins or amino acids can also be added into the care agent. Adding the amino acids can help reduce dryness, fragility, and branching of the hairs. This improves the softness and glossiness of the hairs. Adding the vitamins can provide additional care for the skin.

In this embodiment, a material of the pillow interior 4 includes at least one of down feather, memory foam, latex, or fibers. The pillow interior made of the down feather has a light weight and excellent insulation performance, which can provide a warm feeling in the cold season. Meanwhile, the pillow interior made of the down feather usually has good breathability, which helps maintain good air circulation. The pillow interior made of the memory foam can provide a personalized support according to the shapes of the head and neck, which helps relieve the cervical pressure. The pillow interior made of the latex have certain antibacterial property, which helps prevent bacterial growth and reduce odors. The pillow interior made of the fiber material is suitable for people who are allergic to some feathers, and the pillow interior made of the fiber material is usually easy to clean and convenient to maintain. The pillow interiors made of different materials can meet the personalized needs of different people.

In this embodiment, the pillow interior 4 has a first through channel 41. The first through channel 41 penetrates from an upper side to a lower side of the pillow interior 4. The upper covering surface 11 of the pillowcase main body 1 includes a first connecting part 111, and the lower covering surface 12 of the pillowcase main body 1 includes a second connecting part 121. The first connecting part 111 and the second connecting part 121 are detachably connected into the first through channel 41. The first connecting part 111 and the second connecting part 121 are detachably connected into the first through channel 41 to fix the pillow interior 4 in the pillowcase main body 1. Through this connection method, the pillow interior 4 can be kept at a certain position relative to the pillowcase, which avoids the sliding of the pillow interior 4 from affecting the user experience. Meanwhile, the first through channel 41 can promote the air circulation, which helps regulate the temperature and humidity inside the pillow to provide a more comfortable sleep environment. In addition, this connection method makes the appearance of the pillow more integral and smoother, avoids some exposed connecting structures or seams, improves the overall aesthetics, and gives people a simple and exquisite feeling. Due to the fact that the first connecting part 111 and the second connecting part 121 are in the first through channel 41, it is possible to prevent the user from being in direct contact with the first connecting part 111 or the second connecting part 121, thereby avoiding a possible discomfort.

Figure 5:
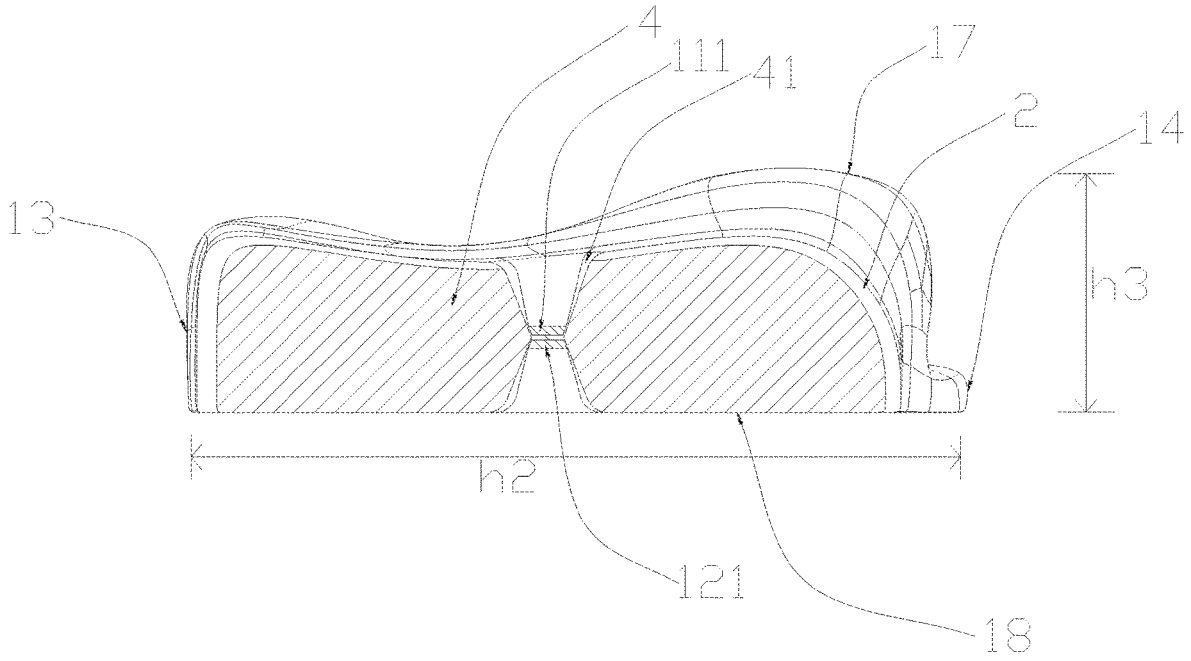
FIG. 5 is cross-sectional view of a side surface of a pillow according to the present disclosure.

As shown in FIG. 5, in this embodiment, the first connecting part 111 and the second connecting part 121 are buttons. In other embodiments, the first connecting part 111 and the second connecting part 121 can also be connected in different ways, such as magnetic buckles, zippers, and hooks, to meet the needs of different users.

Figure 6:
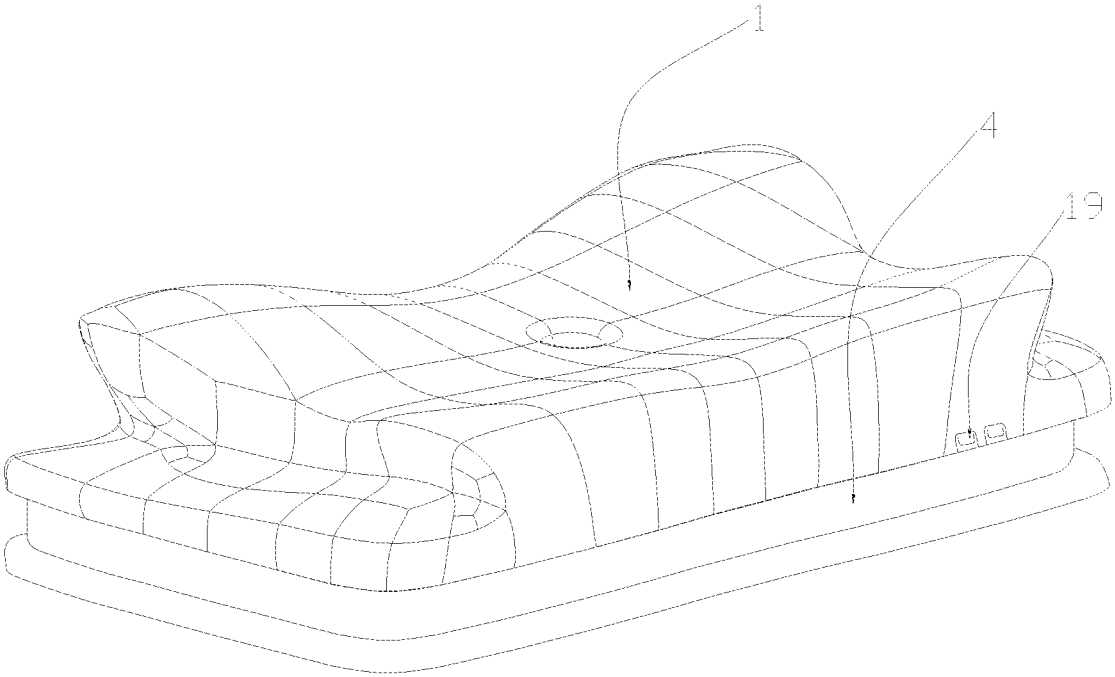
FIG. 6 is a schematic diagram of an entire structure of a pillow according to another embodiment of the present disclosure.

As shown in FIG. 6, in another embodiment, the upper covering surface 11 and the lower covering surface 12 are detachably connected (for example, by at least one fastener 19 or another detachable hook and loop fastener or a zipper), so that at least one edge of a joint between the upper covering surface 11 and the lower covering surface 12 is completely detached or connected, so as to sleeve the pillowcase main body 1 on the pillow interior 4 or separate the pillowcase main body 1 from the pillow interior 4.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A pillow, comprising:

a pillow interior; and a pillowcase main body, wherein the pillowcase main body is made of a fabric;

the pillowcase main body comprises an upper covering surface and a lower covering surface: the upper covering surface is connected to the lower covering surface to form a first accommodating space around the upper covering surface and the lower covering surface: the first accommodating space is configured to accommodate the pillow interior: the fabric comprises a carrier and a care agent: the care agent is mixed with the carrier; and a material of the carrier comprises spandex and a polyamide fiber, wherein an ingredient of the care agent comprises at least sodium hyaluronate, and the ingredient is directly fixed in the fabric with the carrier, by an immersion method with a liquid pick-up rate being controlled between 60% and 80%, and the care agent being added to the carrier according to a ratio of 20 g/L to 50 g/L, and then shaping and drying to mix the care agent with the carrier.

2. The pillow according to claim 1, wherein the carrier is formed by interweaving the polyamide fiber with the spandex, so that the fabric has good elasticity, breathability, wear resistance, and creasing resistance.

3. The pillow according to claim 1, wherein the polyamide fiber in the carrier accounts for 60% to 95%, and the spandex accounts for 40% to 5%.

4. The pillow according to claim 1, wherein the pillowcase main body comprises a front side, a rear side, a left side, a right side, an upper side, and a lower side; a distance from the left side to the right side is a first distance, and the first distance is 30 cm to 145 cm: a distance from the front side to the rear side is a second distance, and the second distance is 15 cm to 60 cm: a distance from the upper side to the lower side is a third distance; and the third distance is 0 to 16 cm.

5. The pillow according to claim 1, wherein the pillowcase main body at least comprises one accommodating opening; and the pillow interior is placed in the first accommodating space through the accommodating opening.

6. The pillow according to claim 1, wherein the care agent further comprises at least one of a moisturizer, an antioxidant, and a spice.

7. The pillow according to claim 1, wherein a material of the pillow interior comprises at least one of down feather, memory foam, latex, and fibers.

8. The pillow according to claim 1, wherein the pillow interior has a first through channel; the first through channel penetrates from an upper side to a lower side of the pillow interior; the upper covering surface of the pillowcase main body comprises a first connecting part; the lower covering surface of the pillowcase main body comprises a second connecting part; and the first connecting part and the second connecting part are detachably connected into the first through channel.

* * * * *